US006131671A

United States Patent [19]

Shibata et al.

[11] Patent Number: 6,131,671

[45] **Date of Patent: *Oct. 17, 2000**

[54] POWER-DRIVEN TOOL HAVING A MECHANISM FOR SETTING THE ROTARY ANGLE POSITION OF A TOOL BIT

[75] Inventors: Mitsuyoshi Shibata; Masaaki Uchida, both of Anjo, Japan

[73] Assignee: Makita Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/771,972

[22] Filed: Dec. 23, 1996

[30] Foreign Application Priority Data

Dec. 25, 1995 [JP] Japan ..... 7-337504

[51] Int. Cl.[7] ..... E02D 7/02

[52] U.S. Cl. ..... 173/48; 173/104; 173/201

[58] Field of Search ..... 173/48, 104, 201, 173/200, 109, 13; 279/19.3, 19.4, 19.5, 71, 81, 905

[56] References Cited

U.S. PATENT DOCUMENTS

| | | | |
|---|---|---|---|
| 3,006,202 | 10/1961 | Moorhead | 173/48 |
| 3,145,782 | 8/1964 | De Bruin | 173/48 |
| 3,507,337 | 4/1970 | Chromy | 173/48 |
| 3,536,335 | 10/1970 | Schmuck | 279/81 |
| 3,747,946 | 7/1973 | Edens | 279/81 |
| 3,774,699 | 11/1973 | Schmuck | 173/48 |
| 3,837,409 | 9/1974 | Consoli | 173/48 |
| 3,874,460 | 4/1975 | Schmid | 173/109 |
| 4,107,949 | 8/1978 | Wanner | 64/9 |
| 4,131,165 | 12/1978 | Wanner | 173/48 |
| 4,231,581 | 11/1980 | Benedict | 279/19.4 |
| 4,236,588 | 12/1980 | Möldan et al. | 173/48 |
| 4,280,359 | 7/1981 | Schmid | 73/123 |
| 4,491,444 | 1/1985 | Rumpp | 173/48 |
| 4,491,445 | 1/1985 | Hunger et al. | 279/19.3 |
| 4,585,077 | 4/1986 | Bergler | 173/48 |
| 4,626,146 | 12/1986 | Neumaier | 279/19.6 |
| 4,691,929 | 9/1987 | Neumaier et al. | 279/19.3 |
| 5,320,177 | 6/1994 | Shibata | 173/48 |
| 5,603,516 | 2/1997 | Neumaier | 279/19.5 |

FOREIGN PATENT DOCUMENTS

| | | |
|---|---|---|
| 0 029 968 | 6/1981 | European Pat. Off. . |
| 35 39 912 A1 | 5/1988 | Germany . |
| 42 05 840 A1 | 9/1993 | Germany . |
| 93 05 034 U | 9/1994 | Germany . |
| 43 10 835 | 10/1994 | Germany . |
| 43 10 835 A1 | 10/1994 | Germany . |
| 34 21 811 C2 | 11/1995 | Germany . |
| 2 276 578 | 10/1994 | United Kingdom . |

*Primary Examiner*—Peter Vo
*Assistant Examiner*—Jim Calve
*Attorney, Agent, or Firm*—Foley, Hoag & Eliot, LLP

[57] ABSTRACT

A power-driven hammer has a tool holder a middle bore portion which is supported inside a housing and urged backward by a compression spring. The rear end of a large bore portion of the tool holder is slidably fitted into a spline ring which is secured to the front end of a middle housing. Spline grooves are formed in the inner periphery of the spline ring at its front end while spline gears are formed on the outer periphery of the large bore portion. When the spline grooves and the spline gears are engaged with each other, the tool holder, being urged backward, is locked with its rotation prohibited. This tool holder can be temporarily unlocked to allow its rotation by sliding a change ring cover forward and the tool holder itself, thereby disengaging the large bore portion from the spline ring.

8 Claims, 3 Drawing Sheets

POWER-DRIVEN TOOL HAVING A MECHANISM FOR SETTING THE ROTARY ANGLE POSITION OF A TOOL BIT

BACKGROUND OF THE INVENTION

1. Field of the invention

This invention relates to a power-driven tool in which a tool bit is mounted in the front end of the tool holder which is rotatably supported in the hammer body. More specifically, this invention relates to such a power-driven tool in which the rotary angle position of a tool bit is adjustable after the tool bit is attached.

2. Description of the Prior Art

Generally, a tool bit attached to the power-driven tool is integrally rotatable with the tool holder by means of a lock mechanism provided in the front of a power-driven tool. Some tool bits, such as chisels, need to be fixed in the tool holder at an appropriate rotary angle position for ease of use. Japanese Patent Application Laying-Open Gazettes Nos. 54-27801 and 61-19395, address such a need. In these prior-art hammer drills, a tool bit is engaged with or disengaged from a clutch member disposed between the tool holder and the output gears for selecting an operation mode from: a drill mode in which only rotation is transmitted to the tool bit; a hammer mode in which only hammer strikes are transmitted; and a hammer drill mode in which rotation and hammer strikes are transmitted at the same time. The tool holder can be placed in an idling position in which the tool holder is disengaged from the clutch member to permit the rotary angle position of the tool bit to be adjusted. Once the tool bit is set to a desired rotary angle position, the tool holder is locked with the clutch member or some other rotation preventive mechanism. This structure is a particularly useful feature when the tool bit is a chisel as it allows the rotary angle position of the tool bit to be adjusted even after it is mounted.

In this structure, however, there is a considerable distance between a sleeve with which to operate the lock mechanism to mount the tool bit in the tool holder and the clutch member with which to place the tool holder in the idle position. This gives rise to the following two problems: poor operability arising from the fact that the mounting of the tool bit and the setting of its rotary angle position must be performed separately by two separate mechanisms disposed remotely from each other and increased cost for providing the two mechanisms required to carry out the bit mounting and the rotary angle setting. Thus, the foregoing configuration is suitable for hammer drills which selectively perform either bit rotation, hammer strikes, or both, but not for power-driven hammers or similar tools designed to perform only one type of operation.

SUMMARY OF THE INVENTION

In view of the above, it is an objective of the present invention to provide a power-driven hammer which allows the rotary angle position of the tool bit to be adjusted by a simple operation after the bit is mounted.

Another objective of the present invention is to provide a power-driven hammer which realizes the above-described adjustment of the rotary angle position of the tool bit with a simple construction having a small number of parts.

The above and other related objects are realized by providing a power-driven tool comprising a tool holder rotatably and axially slidably held in a tool body, a lock mechanism provided at the front of the tool holder for securing a tool bit to the tool holder, an operating member for actuating the lock mechanism to secure the tool bit to the tool holder and for axially sliding the tool holder, a means for urging the tool holder in the direction opposite to the tool bit, and an anti-rotation member for engaging with the tool holder when the tool holder is slid to a rear position by the urging means so as to prohibit the tool holder from rotating.

Preferably, the above operating member is a generally cylindrical sleeve coaxially surrounding the lock member. The operating member can also be rotated and slid in the axial direction by external force.

In carrying out the invention in one preferred mode, the lock mechanism is actuated by the rotation of the operating member to detachably mount a tool bit in the power-driven tool.

In accordance with one aspect of the present invention, the anti-rotation member is a cylindrical sleeve provided with axial grooves, each of the grooves having an identical shape, and the tool holder has axial teeth formed in the rear end thereof for engaging with the axial grooves, each of the grooves having an identical shape. In this configuration, the tool holder can, by actuating the operating member, be slid forward so as to be disengaged from the anti-rotation member, be rotated to a desired angle, and be slid back so as to be re-engaged with the anti-rotation member, thereby changing the rotary angle position of the tool bit. Preferably, the urging means is a coil spring interposed between the lock member and the anti-rotation member.

BRIEF DESCRIPTION OF THE DRAWINGS

For a fuller understanding of the nature and objects of the present invention, reference should be made to the following detailed description and the accompanying drawings, in which.

DETAILED EXPLANATION OF THE PREFERRED EMBODIMENT

Figure 1:
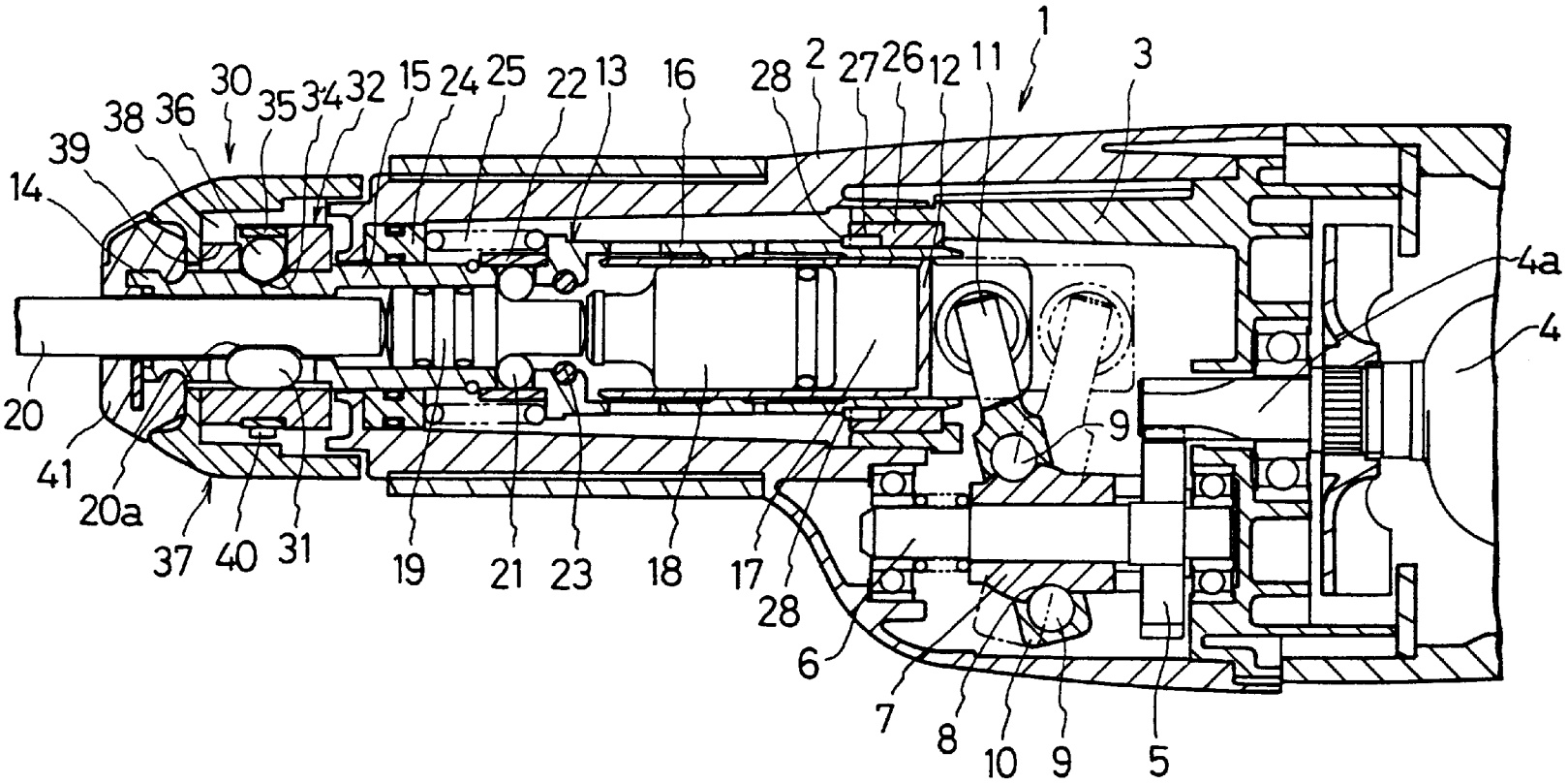
FIG. 1 is a vertical sectional view of the a power-driven hammer.

FIG. 1 depicts a vertical sectional view of a power-driven hammer 1 constructed according to the present invention. A motor 4 is disposed in the rear of the hammer 1, which is to the right of the figure, with its shaft 4*a* meshed with a helical gear 5. A gear shaft 6 is formed through, and integrally with, the helical gear 5 and supported in parallel to the motor shaft 4*a*. The rotation of the motor 4 is thus transmitted via the shaft 4*a* and the helical gear 5 to the gear shaft 6. A boss 7 is fitted around and rotatable integrally with the gear shaft 6. An annular groove 8 is formed in the boss 7 at an angle to the axis of the gear shaft 6. A ring 10 is loosely fitted on the boss 7 with a plurality of balls 9 received in the annular groove 8. An arm 11 extending from the ring 10 is connected with the rear end of a piston cylinder 12. When the gear shaft 6 and the boss 7 are rotated together, the annular groove 8 and the balls 9 cooperatively cause the ring 10 to move back and forth, thereby reciprocating the piston cylinder 12.

The piston cylinder 12, is coaxially and slidably mounted in a large bore portion 16 of the rear of a tool holder 13. A striking member 18 is contained within the piston cylinder 12. Also, an air chamber 17 is formed between the rear end of the cylinder 12 and the striking member 18. The reciprocating motion of the piston cylinder 12, caused by the rotation of the boss 7, in turn creates an air spring effect in the air chamber 17, thereby causing the striking member 18 to also reciprocate in the cylinder 12. The striking member 18, when reciprocating, strikes an intermediate member 19 mounted in a middle bore portion 15 of the tool holder 13. The intermediate member 19, in turn, strikes the rear end of a tool bit 20 which penetrates a small bore portion 14 of the tool holder 13.

Also, reference numeral 21 designates steel balls held in position by a ring 22 to limit the backward movement of the intermediate member 19. Reference numeral 23 designates an O-ring that catches the protruding front end of the striking member 18 during idling operation, thereby preventing the striking member 18 from further reciprocation.

Figure 2:
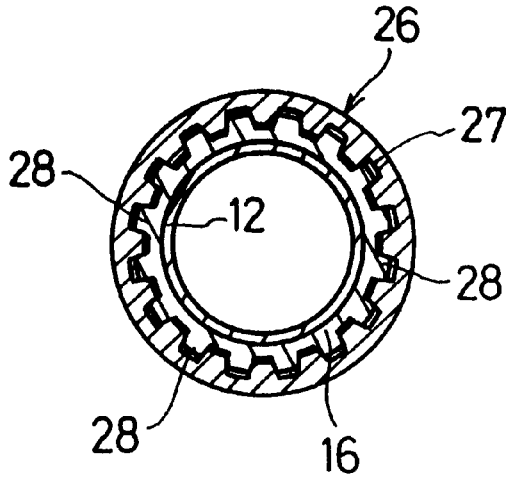
FIG. 2 is a schematic cross sectional view showing the engagement of the spline ring with the tool holder of the power-driven hammer shown in FIG. 1.

The tool holder 13 is supported at its middle bore portion 15 by a clamp ring 24 provided in a housing 2, and urged backward by a compression spring 25 interposed between the clamp ring 24 and the large bore portion 16. A spline ring 26 is secured to the front end of a middle housing 3 which supports the motor shaft 4*a* and the gear shaft 6 inside the housing 2. The rear part of the large bore portion 16 is slidably fitted into the spline ring 26. As shown in FIG. 2, the spline ring 26 has axial spline grooves 27 formed in the inner periphery on its front end while the large bore portion 16 has matching axial spline gears 28 formed on the outer periphery. In the position shown in FIG. 1, the large bore portion 16 of the tool holder 13 is urged backward by the compression spring 25 into the spline ring 26 to engage the spline gears 28 with the spline grooves 27. Thus, the tool holder 13 is locked with its rotation prohibited in this position.

Figure 3:
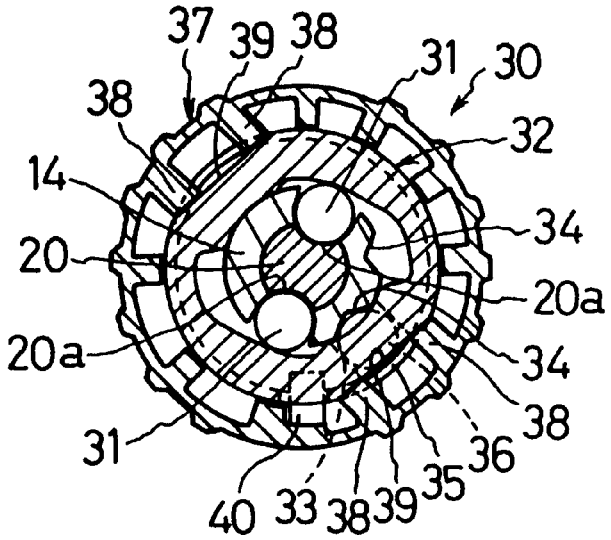
FIG. 3 is a cross sectional view of the lock mechanism for tool bits shown in FIG. 1.

The small bore portion 14 of the tool holder 13 is provided with a lock mechanism 30 for the tool bit 20. As shown in FIG. 3, the small bore portion 14 is provided with radially movable rollers 31 that can fit into axially extending roller grooves 20*a* formed in the tool bit 20. A change ring 32 surrounds the roller grooves 20*a* and the rollers 31 and has a gradually varied thickness around its circumference. By virtue of the varied circumferential thickness, the change ring 32 can assume two positions, by rotation. One is a locking position shown in FIG. 3, in which, the inner surface of the change ring 32 presses the rollers 31 toward the center, thereby locking the tool bit 20. The other is a release position in which the rollers 31 are allowed to move radially, thereby releasing the tool bit 20. The change ring 32 assumes the release position when rotated counterclockwise from the locking position shown in FIG. 3. The small bore portion 14 is further provided with two recesses 34 in its outer periphery. Also, a ball 36 is mounted in a through hole 33 of the change ring 32 and prevented from slipping out by a leaf spring 35. When the ring 32 is rotated to switch from one of the aforementioned two positions to the other, the ball 36 is forced out of one recess 34 and fit into the other, thereby allowing the change ring 32 to hold the new position.

The change ring 32 has a change ring cover 37 rotatably mounted therearound. The change ring cover 37 can be manually operated to slide in the axial direction. A plurality of large ribs 38 formed on the inner periphery of the change ring cover 37 abut a pair of chamfered portions 39 also diametrically formed on the outer periphery of the change ring 32. Accordingly, when the change ring cover 37 is rotated, the abutment between the large ribs 38 and the chamfered portions 39 also makes the change ring 32 rotate. Simultaneously, the change-over of the rollers 31 can be effected between the locking position and the release position. Numeral 40 (see FIG. 3) designates a spring pin, secured to the change ring 32, for positioning the leaf spring 35.

Disposed in front of the change ring cover 37 is a cap 41 which fits around the top end of the small bore portion 14 and which restricts the movement of the change ring cover 37. By sliding the change ring cover 37 forward, the cap 41 and the tool holder 13 can be moved forward, together with the lock mechanism 30, against the urging of the compression spring 25.

Figure 4:
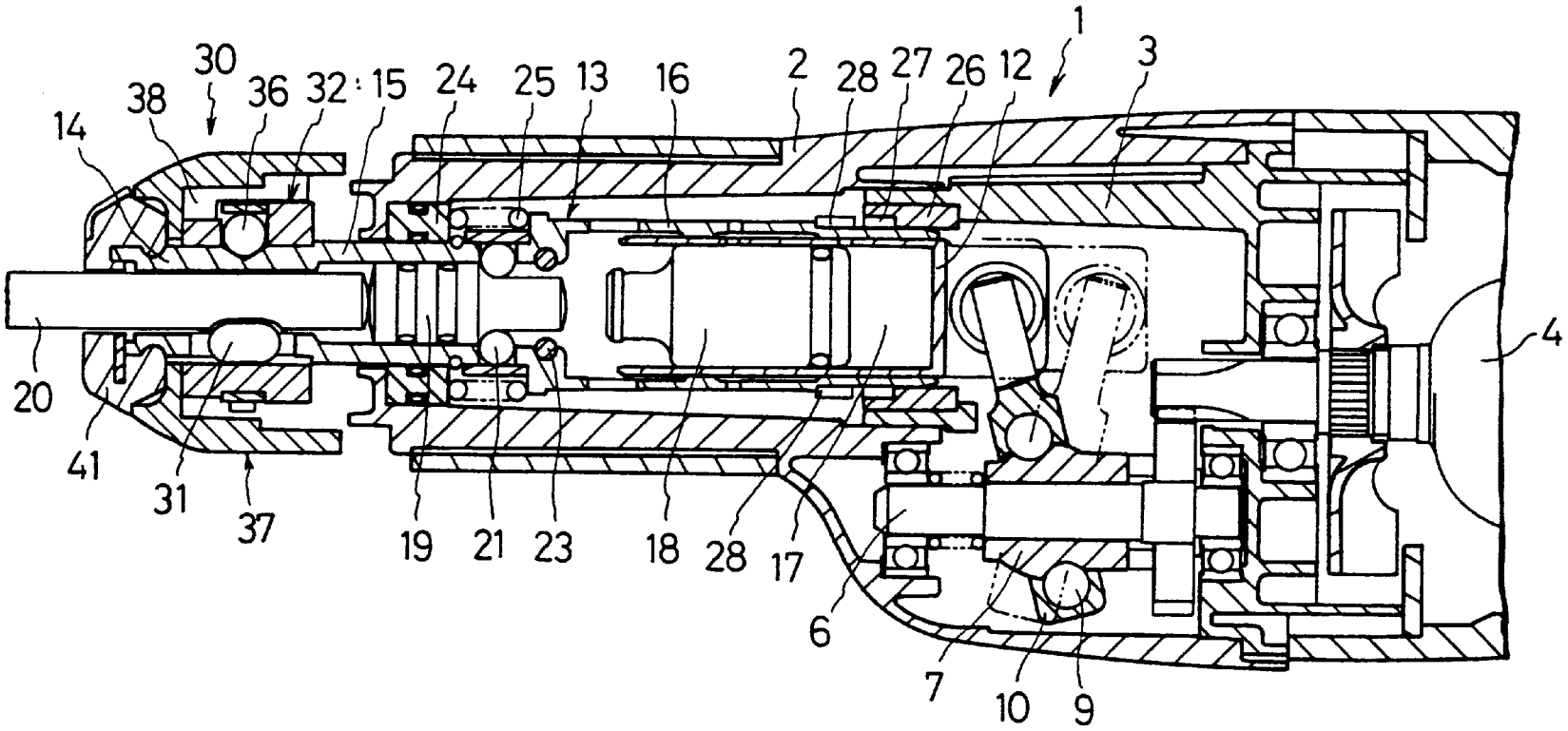
FIG. 4 is a vertical sectional view showing the power-driven hammer of FIG. 1 with the change ring cover slid to the most forward position.

According to the power-driven hammer 1 thus constructed, the tool bit 20 is mounted in the following manner. First, the change ring cover 37 is rotated so as to set the change ring 32 in the release position, where the tool bit 20 is inserted into the small bore portion 14 of the tool holder 13. Then, the change ring cover 37 is rotated in the opposite direction so as to place the change ring 32 in the locking position. This causes the rollers 31, pressed by the inner periphery of the change ring 32, to engage with the roller grooves 20*a* of the tool bit 20, thereby firmly connecting the tool bit 20 with the tool holder 13. If it is desired to adjust the rotary angle position of the tool bit 20, as often occurs with a chisel, the change ring cover 37 is slid forward as shown in FIG. 4. At the same time, the tool holder 13 is moved forward via the cap 41 with the tool bit 20 locked therein while the spline gears 28 of the large bore portion 16 are disengaged from the spline grooves 27 of the spline ring 26. Thus, the tool bit 20 can be freely rotated to a desired position via the cap 41 by operating the change ring cover 37. After placing the tool bit 20 in a desired rotary angle position, the change ring cover 37 is slid backward to engage the spline gears 28 of the large bore portion 16 with the spline grooves of the spline ring 26. In this way, the tool bit 20 is locked in the desired position and is thus prevented from any further rotation.

During idling operation, in which the motor 4 is driven without the tool bit 20 mounted, the first strike causes the intermediate member 19 to move forward to the front end of the middle bore portion 15. At the same time, the striking member 18 is moved forward to the front end of the large bore portion 16, where its front end is caught in the O-ring 23. Therefore, the striking member 18 is no longer pneumatically interlocked with the reciprocating piston cylinder 12 so that further idle strikes are prevented. It should be noted that during idling operation, the compression spring 25 serves as a buffer to alleviate the impact transmitted to the front portion of the power-driven hammer 1.

According to the embodiment, not only can the tool bit 20 be easily mounted or detached, but its rotary angle position can also be easily changed, both by the operation of a single member of the change ring cover 37. This simple construction, requiring a small number of parts, improves the operability of the power-driven hammer of the embodiment while reducing its manufacturing cost.

As there may be many other modifications, alterations, and changes without departing from the scope or spirit of the essential characteristics of the present invention, it is to be understood that the above embodiment is only an illustration and not restrictive in any sense. The scope or spirit of the present invention is limited only by the terms of the appended claims.

In the foregoing embodiment, the tool bit is mounted or detached by rotating the change ring cover of the lock mechanism. However, the lock mechanism of the tool bit may be of a different type. For example, the lock mechanism may be modified so as to lock and release the tool bit by sliding the change ring cover back and forth.

Also, the present invention is applicable to different types of power-driven tools, such as hammer drills, other than power-driven hammers as in the embodiment.

What is claimed is:

1. A power-driven hammer operable to impart reciprocating motion to a striking tool, said power driven hammer comprising a tool body, a cylindrical tool holder held in the tool body and having a front end for receiving the striking tool, a rear end for receiving a striking action therein and a tool axis extending between the front and rear ends, the tool holder being slidable along the tool axis relative to the tool body between a front position, in which the tool holder can be rotated about the tool axis and relative to the tool body, and a rear position, in which the tool holder is rotationally fixed at a selected rotary angle relative to the tool body, a lock mechanism at the front end of the tool holder for selectively securing the striking tool to the tool holder, an operating member coupled to the lock mechanism and movable between a locking position for actuating the lock mechanism to secure the striking tool to the tool holder and a release position for actuating the lock mechanism to release the striking tool, means for urging the tool holder along the tool axis and toward the rear end of the tool body, and an anti-rotation member secured within the tool body, the anti-rotation member engaging the tool holder when the tool holder is slid to the rear position by the urging means, so as to maintain the tool holder at a selected rotary angle relative to the tool body, and disengaging from the tool holder when the tool holder is slid to the front position, to permit rotation of the tool holder relative to the tool body.

2. A power driven hammer in accordance with claim 1, wherein the operating member is a generally cylindrical sleeve coaxially surrounding the lock mechanism, the operating member being rotatable about the tool axis relative to the tool body between the release position and the locking position and axially slidable relative to the tool body along the tool axis.

3. A power-driven hammer in accordance with claim 2, wherein the lock mechanism is actuated by the rotation of the operating member to detachably mount the tool bit in the power-driven hammer.

4. A power-driven hammer in accordance with claim 3 wherein the urging means comprises a coil spring interposed between the lock member and the anti-rotation member.

5. A power-driven hammer in accordance with claim 2, wherein the anti-rotation member is a cylindrical sleeve provided with axial grooves and the tool holder has axial teeth formed in the rear end thereof for engaging with the axial grooves so that when the operating member is actuated, the tool holder can be slid forward relative to the tool body to disengage from the anti-rotation member, rotated to said select rotary angle relative to the tool body, and slid back to re-engage the anti-rotation member, thereby changing the rotary angle position of the tool bit relative to the tool body.

6. A power-driven hammer in accordance with claim 5 wherein the urging means comprises a coil spring interposed between the lock member and the anti-rotation member.

7. A power-driven hammer in accordance with claim 2 wherein the urging means comprises a coil spring interposed between the lock member and the anti-rotation member.

8. A power-driven hammer in accordance with claim 1, wherein the urging means comprises a coil spring interposed between the lock member and the anti-rotation member.

* * * * *